US007339553B2

(12) United States Patent
Nagao et al.

(10) Patent No.: US 7,339,553 B2
(45) Date of Patent: Mar. 4, 2008

(54) PLASMA DISPLAY

(75) Inventors: Nobuaki Nagao, Katano (JP); Yusuke Takada, Katano (JP); Toru Ando, Osaka (JP); Masaki Nishimura, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 412 days.

(21) Appl. No.: 10/480,324

(22) PCT Filed: Jun. 11, 2002

(86) PCT No.: PCT/JP02/05768

§ 371 (c)(1),
(2), (4) Date: Jul. 19, 2004

(87) PCT Pub. No.: WO02/101705

PCT Pub. Date: Dec. 19, 2002

(65) Prior Publication Data

US 2004/0251830 A1 Dec. 16, 2004

(30) Foreign Application Priority Data

Jun. 12, 2001 (JP) ..... 2001-176575

(51) Int. Cl.
*G09G 3/28* (2006.01)

(52) U.S. Cl. ..... 345/60; 345/62; 345/66; 345/67; 345/68

(58) Field of Classification Search ..... 345/60–69; 315/160–176; 313/574–586, 633
See application file for complete search history.

(56) References Cited

U.S. PATENT DOCUMENTS 5,745,086 A 4/1998 Weber ..... 345/63
6,011,355 A 1/2000 Nagai ..... 345/60
6,020,687 A 2/2000 Hirakawa et al. ..... 315/169.1
6,476,561 B2 * 11/2002 Okada ..... 315/169.1
6,603,447 B1 8/2003 Ito et al. ..... 345/60
6,653,993 B1 11/2003 Nagao et al. ..... 345/60
6,653,994 B2 * 11/2003 Takeda et al. ..... 345/60
6,738,033 B1 5/2004 Hibino et al. ..... 345/60
6,876,343 B2 * 4/2005 Myoung et al. ..... 345/67
7,068,244 B2 * 6/2006 Nagao et al. ..... 345/60
7,068,245 B2 * 6/2006 Nagao et al. ..... 345/60
2002/0167466 A1 11/2002 Setoguchi et al.

(Continued)

FOREIGN PATENT DOCUMENTS

EP 0 903 719 7/1998

(Continued)

*Primary Examiner*—Vijay Shankar

(57) ABSTRACT

A plasma display panel with a drive circuit that divides a field into a plurality of sub-fields with each sub-field including a write period, a discharge sustain period and an erase period. In the discharge sustain period at least one of a plurality of pulses applied in a later part of the discharge sustain period has a larger pulse width than a pulse applied in an earlier part of the discharge sustain period and in the erase period, a narrow pulse is applied to a pair of electrodes extending across each of a plurality of discharge cells. The narrow pulse has a pulse height lower than a discharge firing voltage of the plurality of discharge cells and a smaller pulse width than the pulses applied in the discharge sustain period.

50 Claims, 9 Drawing Sheets

U.S. PATENT DOCUMENTS

| | | | | |
|---|---|---|---|---|
| 2004/0080280 | A1 | 4/2004 | Hibino et al. | 315/169.4 |
| 2004/0150354 | A1 | 8/2004 | Setoguchi et al. | |
| 2006/0017661 | A1 | 1/2006 | Setoguchi et al. | |
| 2006/0113921 | A1 | 6/2006 | Setoguchi et al. | |

FOREIGN PATENT DOCUMENTS

| | | |
|---|---|---|
| EP | 0 961 258 | 3/1999 |
| EP | 1 047 041 | 4/2000 |
| JP | 7-134565 | 5/1995 |
| JP | 11-85099 | 3/1999 |
| JP | 11-133913 | 5/1999 |
| JP | 11-338414 | 12/1999 |
| JP | 2000-75835 | 3/2000 |
| JP | 2000148083 | 5/2000 |
| JP | 2000-242231 | 9/2000 |
| JP | 2000-259120 | 9/2000 |
| JP | 2000-261739 | 9/2000 |
| JP | 2000-267625 | 9/2000 |
| JP | 2000-305510 | 11/2000 |
| JP | 2001-005423 | 1/2001 |
| JP | 2001-142429 | 5/2001 |
| JP | 2001-337648 | 7/2001 |
| JP | 2001-228820 | 8/2001 |
| JP | 2002-215085 | 7/2002 |
| JP | 3420031 | 4/2003 |
| KR | 2000-0006211 | 1/2000 |
| KR | 2000-0071753 | 11/2000 |
| KR | 2002-0092572 | 12/2002 |
| TW | 349217 | 1/1999 |

* cited by examiner

PLASMA DISPLAY

This application is a 371 of PCT/JP02/05768 Jun. 11, 2002.

TECHNICAL FIELD

The present invention relates to a plasma display apparatus, which is used as a display screen on computers, televisions and the like.

BACKGROUND ART

In recent years, in the field of display apparatuses used for achieving image display on computers, televisions and the like, plasma display panels (hereinafter referred to as PDPs) have been attracting attention. This is because a PDP enables a slim and large panel demonstrating high image quality to be realized.

In a conventional PDP, a pair of a front substrate and a back substrate are arranged so as to oppose each other. Scan electrodes and sustain electrodes are disposed in stripes so as to be parallel to each other on the opposing surface of the front substrate. The scan and sustain electrodes are covered with a dielectric layer. Data electrodes are arranged in stripes on the opposing surface of the back substrate so as to cross over the scan electrodes at right angles. A gap between the front substrate and the back substrate is divided by barrier ribs which are disposed in stripes so as to be parallel to the data electrodes. A discharge gas is enclosed in spaces formed between these barrier ribs. With this structure, a plurality of discharge cells are formed, in a matrix configuration, in areas where the scan electrodes intersect with the data electrodes in the PDP.

This PDP is provided with a driving circuit, to constitute a plasma display apparatus. The PDP is driven by repeating a sequence of a set-up period, a write period, a discharge sustain period, and an erase period, which causes each of the discharge cells to be lit and unlit. In the set-up period, a set-up pulse is applied to initialize all of the discharge cells. In the write period, a data pulse is applied to selected data electrodes, while a scan pulse is sequentially applied to the scan electrodes, to write pixel information. In the discharge sustain period, a sustain pulse having a rectangular waveform is applied with alternating polarity between the scan electrodes and the sustain electrodes, to sustain a main discharge and thereby cause light emission. In the erase period, an erase pulse is applied to the scan electrodes or the sustain electrodes, to erase wall charges in the discharge cells. Here, each discharge cell is fundamentally only capable of two display states, ON and OFF. Therefore, driving is performed in plasma display apparatuses using a field timesharing gradation display method, in which one frame (field) is divided into sub-fields, and ON and OFF states in each sub-field are combined to express a gray scale.

Here, it is desirable to utilize the field timesharing gradation display method together with a technique of suppressing an erroneous discharge, such as illuminating an unselected discharge cell or failing to illuminate a selected discharge cell.

Particularly in the erase period, noise or interference generated by priming particles flowing into a discharge cell from other discharge cells tends to cause an erroneous discharge. To suppress such erroneous discharge, a pulse lower than a discharge firing voltage and narrower than the sustain pulse is applied in the erase period, to stop a sustain discharge. Such a pulse is hereinafter referred to as a "narrow pulse".

However, an erase discharge tends to be less stable in recent plasma display apparatuses, which deliver increasingly higher definition. Accordingly, an erroneous discharge may be caused because of erase defects.

When driving an existing PDP conforming to the video graphics array (VGA) protocol, one field can be divided into around 13 sub-fields. When driving a PDP conforming to the extended graphic array (XGA), however, the number of sub-fields for one field is reduced to 8 to 10, if the lengths of the write period (1.5 ms to 1.9 ms with a write pulse of 2 μs to 2.5 μs in width) and the discharge sustain period are the same as those in the VGA. This means that lower image quality is performed in the XGA PDP than in the VGA PDP. In view of this problem, the pulse width of the sustain pulse applied in the discharge sustain period is reduced from conventional 6 μs to 4 μs, to shorten the discharge sustain period, thereby increasing the number of sub-fields. However, when the sustain pulse is narrower, a smaller wall charge accumulates in the discharge cells as a result of a sustain discharge, which lowers a wall voltage. This makes it difficult to perform an erase discharge in the erase period which follows the discharge sustain period, causing an unstable discharge in the erase period. As a result, discharges in the set-up period and write period that follow the erase period become unstable too. Accordingly, an erroneous discharge is likely to take place, causing a reduction in the image quality.

In the light of the above-mentioned problems, it is an object of the present invention to provide a plasma display apparatus, in which the narrow pulse is used to perform the erase discharge and the discharge sustain period of each sub-field can be shortened so as to achieve high definition with suppressing an erroneous discharge.

DISCLOSURE OF THE INVENTION

The above-mentioned object is achieved by a plasma display apparatus comprising: a plasma display panel in which a plurality of discharge cells are formed between a pair of substrates, and a pair of electrodes extend across each of the plurality of discharge cells; and a driving circuit that drives the plasma display panel in such a manner that one field is divided into a plurality of sub-fields, each of the plurality of sub-fields including (i) a write period in which writing is performed in discharge cells selected from the plurality of discharge cells, (ii) a discharge sustain period in which pulses are applied to the pair of electrodes extending across each of the plurality of discharge cells, to perform a discharge in the selected discharge cells in which the writing has been performed in the write period, and (iii) an erase period in which the discharge that has been performed in the selected discharge cells in the discharge sustain period is discontinued, wherein in the discharge sustain period, at least one of a plurality of pulses applied in a later part of the discharge sustain period has a larger pulse width than a pulse applied in an earlier part of the discharge sustain period, and in the erase period, a narrow pulse is applied to the pair of electrodes extending across each of the plurality of discharge cells, the narrow pulse having a pulse height lower than a discharge firing voltage of the plurality of discharge cells and a smaller pulse width than the pulses applied in the discharge sustain period.

With the above-mentioned construction, wall voltages in the discharge cells observed at the end of the discharge sustain period are raised to a higher level than in the related art, since a wide pulse is applied in the later part of the discharge sustain period. Accordingly, even if a sustain pulse is made narrower to shorten the discharge sustain period, an erase discharge is performed reliably, which suppresses an erroneous discharge in the PDP.

Here, in order to raise the wall voltages in the discharge cells at the end of the discharge sustain period to a higher level than in the related art, it is desirable that the later part of the discharge sustain period starts at a point where a fifth last pulse is applied in the discharge sustain period.

It is particularly effective, in raising the wall voltages, that a final pulse applied in the later part of the discharge sustain period has a larger pulse width than the pulse applied in the earlier part of the discharge sustain period.

Here, a difference in pulse width between (i) the at least one pulse in the later part of the discharge sustain period and (ii) other pulses applied in the discharge sustain period, except for an initial pulse applied in the discharge sustain period, may be in a range of 0.5 μs to 20 μs.

Here, the narrow pulse that is applied in the erase period may be no less than 200 ns but less than 2 μs in width.

Here, in the erase period, after the narrow pulse is applied, a wide pulse having a lower pulse height and a larger pulse width than the narrow pulse may be applied to the pair of electrodes. This enables the wall voltages to be equalized to a certain extent.

Here, in the erase period, a pulse which has a pulse height lower than a discharge firing voltage of the plurality of discharge cells and a gradual rising portion may be applied to the pair of electrodes extending across each of the plurality of discharge cells. This causes a weak discharge to occur in the rising portion of the pulse, reducing discharge delay of an erase discharge. As a result, a discharge is sustained for a longer time period, which enables the erase discharge to be performed more reliably.

Here, each of the plurality of sub-fields may include, prior to the write period, a set-up period in which a pulse is applied to the pair of electrodes to equalize wall charges in the plurality of discharge cells. This makes it easy to perform a write discharge, suppressing the occurrence of an erroneous discharge.

Here, the field may have only one set-up period in which a pulse is applied to the pair of electrodes to initialize the plurality of discharge cells. This reduces worsening of contrast of the PDP caused by light emission generated by a set-up discharge.

Here, the pulse applied in the set-up period may have a gradual rising portion and a gradual falling portion. This causes more wall charges to accumulate, when compared with the use of a rectangular waveform for the pulse applied in the set-up period. Accordingly, an erroneous discharge is reduced.

BEST MODE FOR CARRYING OUT THE INVENTION

The following part describes embodiments of the present invention, with reference to the attached figures. Note that the following embodiments and figures only serve as an example, and the present invention is not limited thereto.

First Embodiment

A plasma display apparatus generally includes a PDP and a driving circuit.

Construction of PDP

A construction of a PDP is described in the following part.

Figure 1:
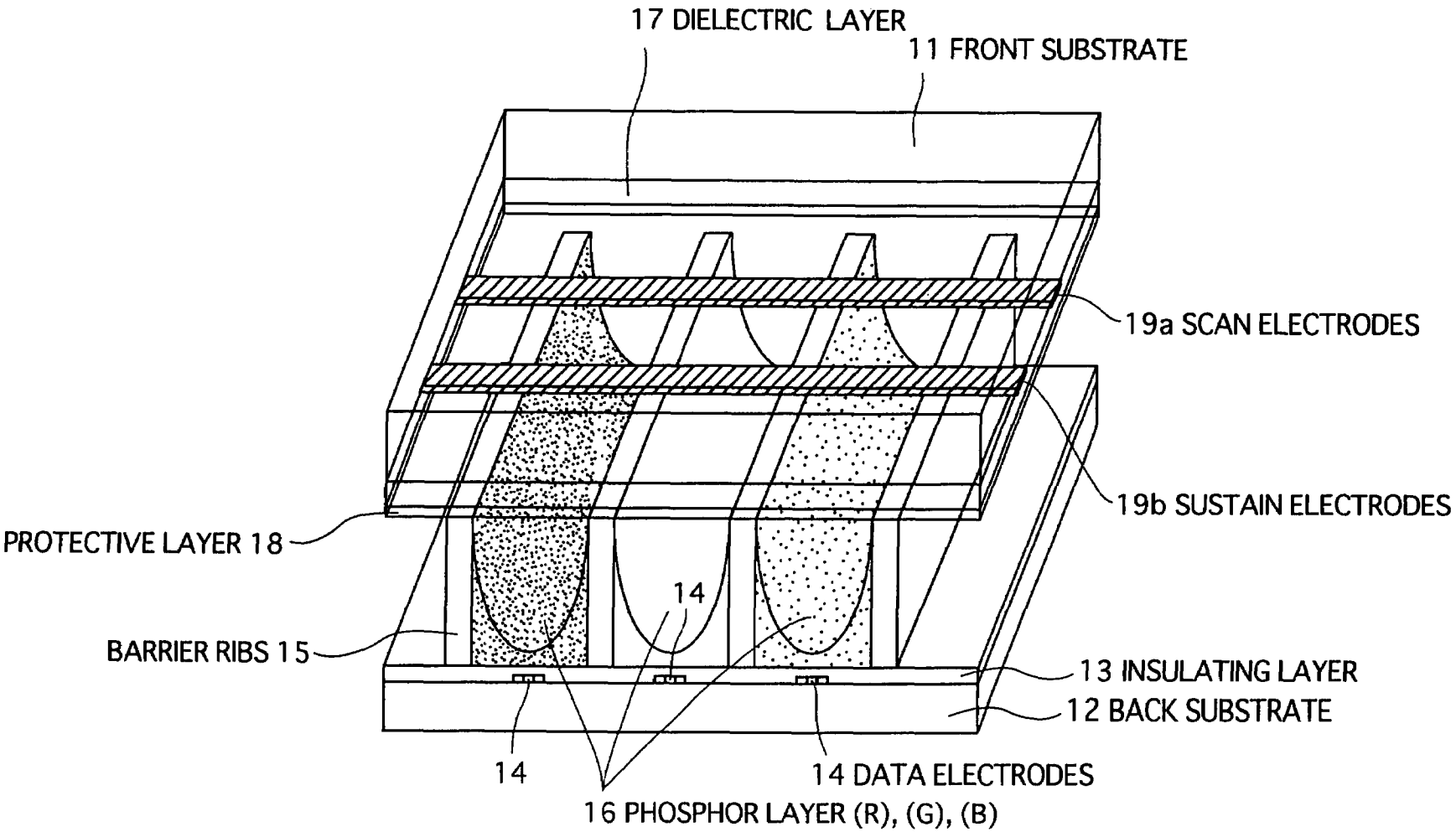
FIG. 1 is a perspective view showing part of a PDP.

FIG. 1 is a perspective view showing part of a PDP relating to the embodiments.

As shown in FIG. 1, in the PDP, a front substrate 11 and a back substrate 12 are disposed in parallel with a gap therebetween, and sealed together about their peripheries (not illustrated) using frit glass or the like.

A plurality of pairs of a scan electrode 19*a* and a sustain electrode 19*b* are arranged in stripes so as to be parallel to each other on the opposing surface of the front substrate 11. The electrodes 19*a* and 19*b* are covered with a dielectric layer 17 composed of lead glass or the like. The surface of the dielectric layer 17 is covered with a protective layer 18 composed of a magnesium oxide (MgO) deposition film.

Data electrodes 14 are disposed in stripes on the opposing surface of the back substrate 12 so as to cross over the scan electrodes 19*a* at right angles. The data electrodes 14 are covered with an insulating layer 13 composed of lead glass or the like. Barrier ribs 15 are disposed on the insulating layer 13 in parallel with the data electrodes 14. The barrier ribs 15 are arranged in stripes so as to extend in a vertical direction. The gap between the front substrate 11 and the back substrate 12 is divided into spaces of around 100 μm to around 200 μm by the barrier ribs 15. A discharge gas is enclosed in these spaces.

To achieve monochrome display, a gas mixture mainly composed of neon, which emits visible light, is used for the discharge gas. However, in the color PDP shown in FIG. 1, a gas mixture mainly composed of xenon (Ne—Xe gas mixture, or He—Xe gas mixture) is used as the discharge gas. In the color PDP shown in FIG. 1, a phosphor layer 16 which is made up of phosphors for three primary colors of red (R), green (G), and blue (B) is applied, in turn, on to the inner walls of the discharge cells created between adjacent barrier ribs 15. Color display is achieved by converting ultraviolet light, which is generated in the discharge gas when a discharge is performed, into visible light of each color by means of the phosphor layer 16.

Assuming that the PDP is used under the atmospheric pressure, the discharge gas is generally enclosed at a pressure in a range from around 200 Torr to around 500 Torr (26.6 kPa to 66.5 kPa), so that the pressure inside the PDP is lower than an external pressure.

Figure 2:
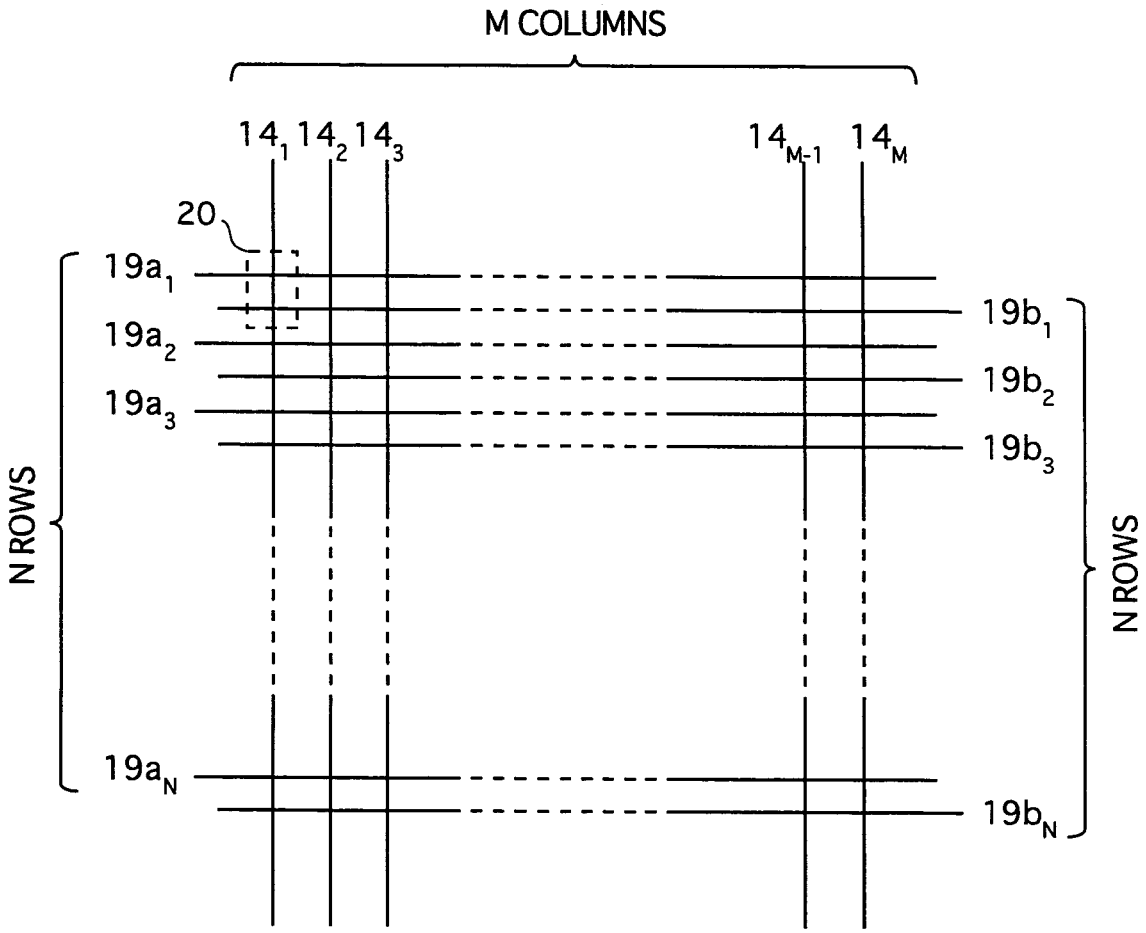
FIG. 2 shows an electrode matrix of the PDP.

FIG. 2 shows an electrode matrix of this PDP. The electrodes $\mathbf{19}a_1$ to $\mathbf{19}a_N$ and the electrodes $\mathbf{19}b_1$ to $\mathbf{19}b_N$ are disposed so as to intersect with the data electrodes $\mathbf{14}_1$ to $\mathbf{14}_M$ at right angles. M×N discharge cells 20 are each formed in an area where one data electrode 14 intersects with one pair of scan electrode 19*a* and sustain electrode 19*b*, between the front substrate 11 and the back substrate 12 (both shown in FIG. 1). The discharge cells 20 are partitioned by the barrier ribs 15 (shown in FIG. 1) so as to be adjacent to each other in the horizontal direction. This keeps a discharge generated in each of the discharge cells 20 from entering adjacent discharge cells. This enables high-resolution display to be realized in the PDP.

An electrode that has a two-layer structure formed by laminating a wide transparent electrode having a high transmittance efficiency and a narrow bus electrode (metal electrode) together is widely used in general PDPs. Such electrode is also used for the scan electrodes 19*a* and sustain electrodes 19*b* in the embodiments. Here, the transparent electrode secures a wide light emission area, and the bus electrode ensures conductivity.

The embodiments employ the above-mentioned electrode formed by a transparent electrode and a metal electrode. However, the use of the transparent electrode is not necessarily required, and a metal electrode alone may be employed.

A concrete example of a manufacturing method for the above-mentioned PDP is described in the following part.

A glass substrate is used for the front substrate 11.

A Cr thin film, a Cu thin film, and a Cr thin film are formed in this order on the front substrate 11 using a sputtering method, and then a resist layer is further formed. This resist layer is exposed to light through a photomask having an electrode pattern, and the result is developed. Then, patterning is performed by removing unnecessary parts of the Cr-Cu-Cr thin film using a chemical etching method. After this, the dielectric layer 17 is formed by printing a lead glass paste with a low softening point, drying it, and then firing the result. The protective layer 18 is an MgO thin film, and formed using an electron-beam evaporation method.

A glass substrate is used for the back substrate 12. The data electrodes 14 are formed on the back substrate 12 by patterning a thick-film silver paste using screen-printing and firing the result. The insulating layer 13 is formed by printing an insulating glass paste on the data electrodes 14 using a screen-printing method and firing the result. The barrier ribs 15 are formed by patterning a thick-film past using screen-printing and firing the result. The phosphor layer 16 is formed by patterning phosphor ink, using screen-printing, on the sides of the barrier ribs 15 and on the insulating layer 13, and firing the result. Then, a Ne—Xe gas mixture including 5% of xenon is enclosed as the discharge gas at a pressure of 500 Torr (66.5 kPa). In this way, the PDP is manufactured.

Driving Circuit

Figure 3:
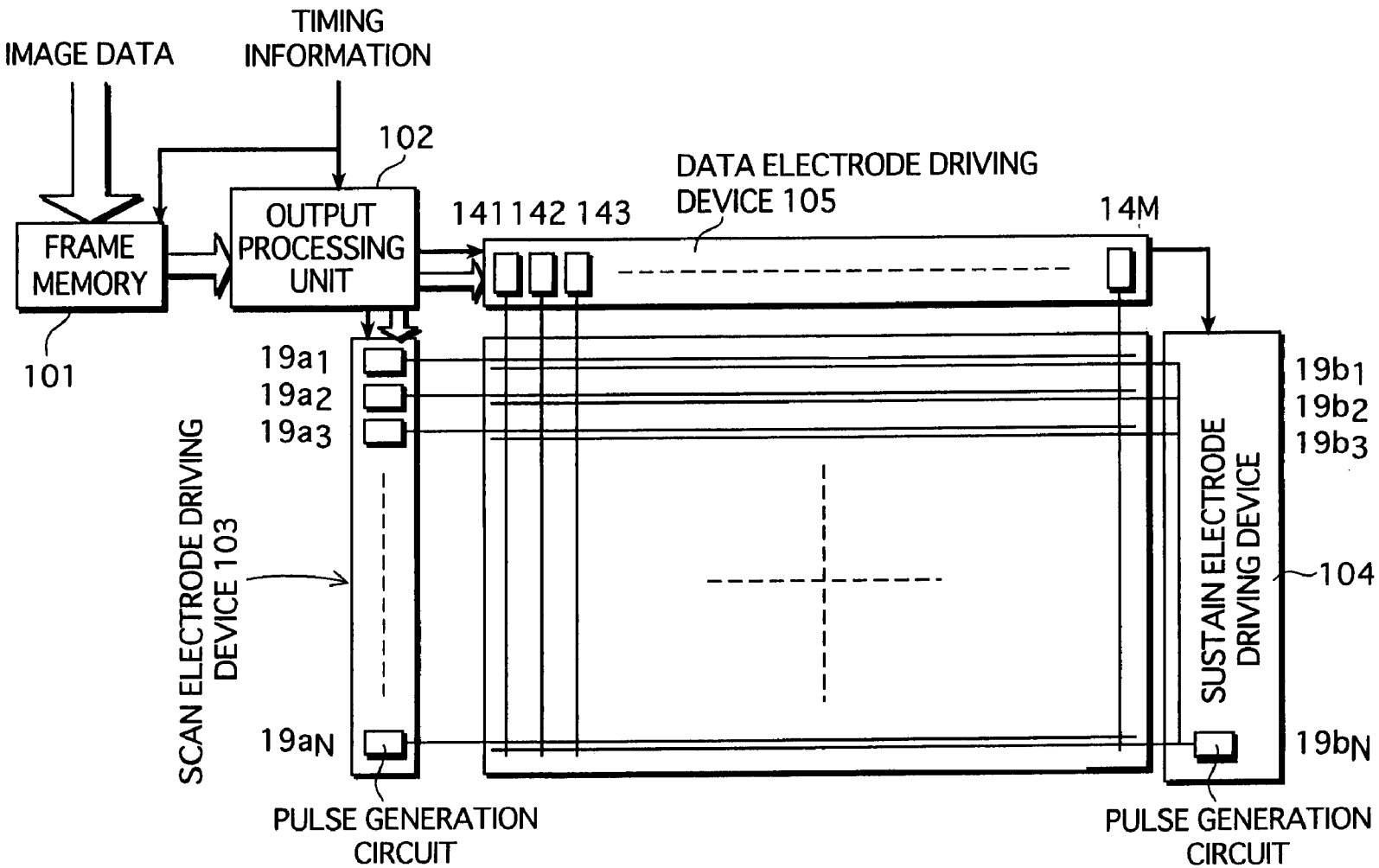
FIG. 3 is a block diagram showing a driving circuit of a plasma display apparatus.

FIG. 3 is a block diagram showing a driving circuit that drives the above-described PDP.

The driving circuit includes: a frame memory 101 which stores image data input from outside; an output processing unit 102 for processing image data; a scan electrode driving device 103 which applies a pulse to the scan electrodes $\mathbf{19}a_1$ to $\mathbf{19}a_N$; a sustain electrode driving device 104 which applies a pulse to the sustain electrodes $\mathbf{19}b_1$ to $\mathbf{19}b_N$; a data electrode driving device 105 which applies a pulse to the data electrodes $\mathbf{14}_1$ to $\mathbf{14}_M$, and the like.

The frame memory 101 stores sub-field image data, which is created by splitting image data for one field into image data of each sub-field.

The output processing unit 102 outputs current sub-field image data stored in the frame memory 101 line by line to the data electrode driving device 105. Also, the output processing unit 102 sends a trigger signal (a timing control signal) to the electrode driving devices 103, 104 and 105, with reference to timing information (e.g. a horizontal synchronization signal and a vertical synchronization signal) that is synchronized with input image data. The trigger signal is used to determine a timing of applying a pulse.

The scan electrode driving device 103 includes pulse generation circuits in a one-to-one correspondence with the scan electrodes 19*a*. The pulse generation circuits are driven in response to the trigger signal sent from the output processing unit 102. With this construction, the scan electrode driving device 103 sequentially applies a scan pulse to the scan electrodes $\mathbf{19}a_1$ to $\mathbf{19}a_N$ in a write period, and also collectively applies a set-up pulse and a sustain pulse to all of the scan electrodes $\mathbf{19}a_1$ to $\mathbf{19}a_N$ respectively in a set-up period and a discharge sustain period.

The sustain electrode driving device 104 includes a pulse generation circuit that is driven responding to the trigger signal sent from the output processing unit 102. The sustain electrode driving device 104 collectively applies a sustain pulse and an erase pulse to all of the sustain electrodes $\mathbf{19}b_1$ to $\mathbf{19}b_N$ respectively in the discharge sustain period and an erase period.

The data electrode driving device 105 includes pulse generation circuits which are driven in response to the trigger signal sent from the output processing unit 102. The data electrode driving device 105 applies a data pulse to electrodes selected from the data electrodes $\mathbf{14}_1$ to $\mathbf{14}_M$ according to sub-field information.

For example, the device described in Japanese laid-open patent application publication No. 2000-267625 can be used for the pulse generation circuits included in the scan electrode driving device 103 and the sustain electrode driving device 104. Here, the pulse width of the sustain pulse applied in the discharge sustain period can be varied (mentioned later), by adjusting the timing control signal which is used for activating/deactivating the scan electrode driving device 103 or the sustain electrode driving device 104 during the discharge sustain period. Such timing control signal is one of the control signals output from the output processing unit 102.

PDP Driving Method

The above-described PDP is driven by the driving circuit using a field timesharing gradation display method.

Figure 4:
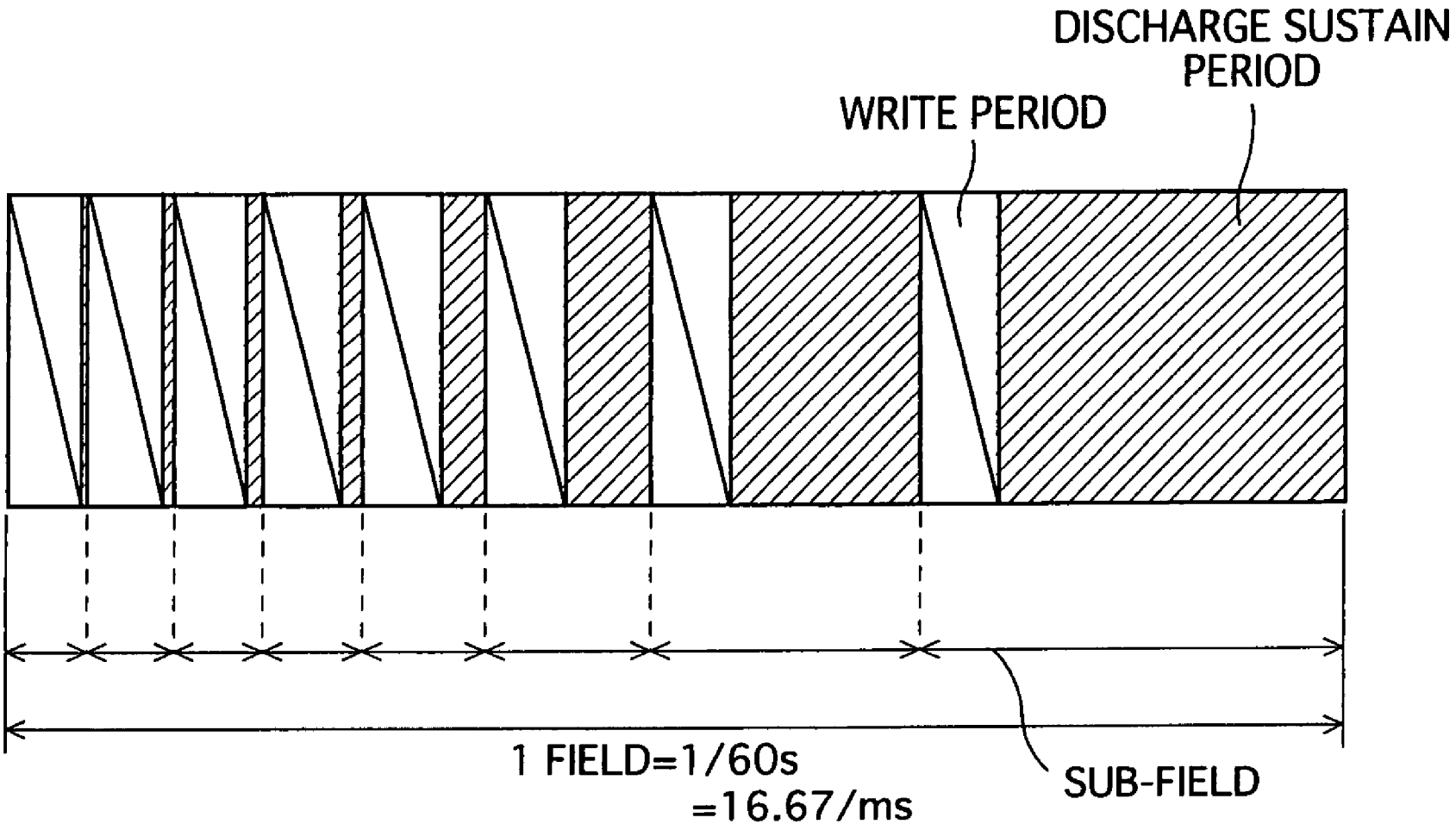
FIG. 4 is a schematic view presenting a division method for one field to express 256 gray levels using a field timesharing gradation display method.

FIG. 4 is a schematic view presenting, as an example, a division method for one field to express 256 gray levels. Time is plotted along the horizontal axis, and the shaded section represents the discharge sustain period.

According to the division method shown in FIG. 4, one field is composed of eight sub-fields. The ratio of the discharge sustain period of the sub-fields is set at 1, 2, 4, 8, 16, 32, 64, 128. Eight-bit binary combinations of the sub-fields can express 256 gray levels. The National Television System Committee (NTSC) standard for television images stipulates a rate of 60 field-images per second, so the time for one field is set at 16.7 ms.

Each sub-field has, for example, a sequence of the set-up period (not shown in FIG. 4), the write period, the discharge sustain period, and the erase period (not shown in FIG. 4).

Figure 5:
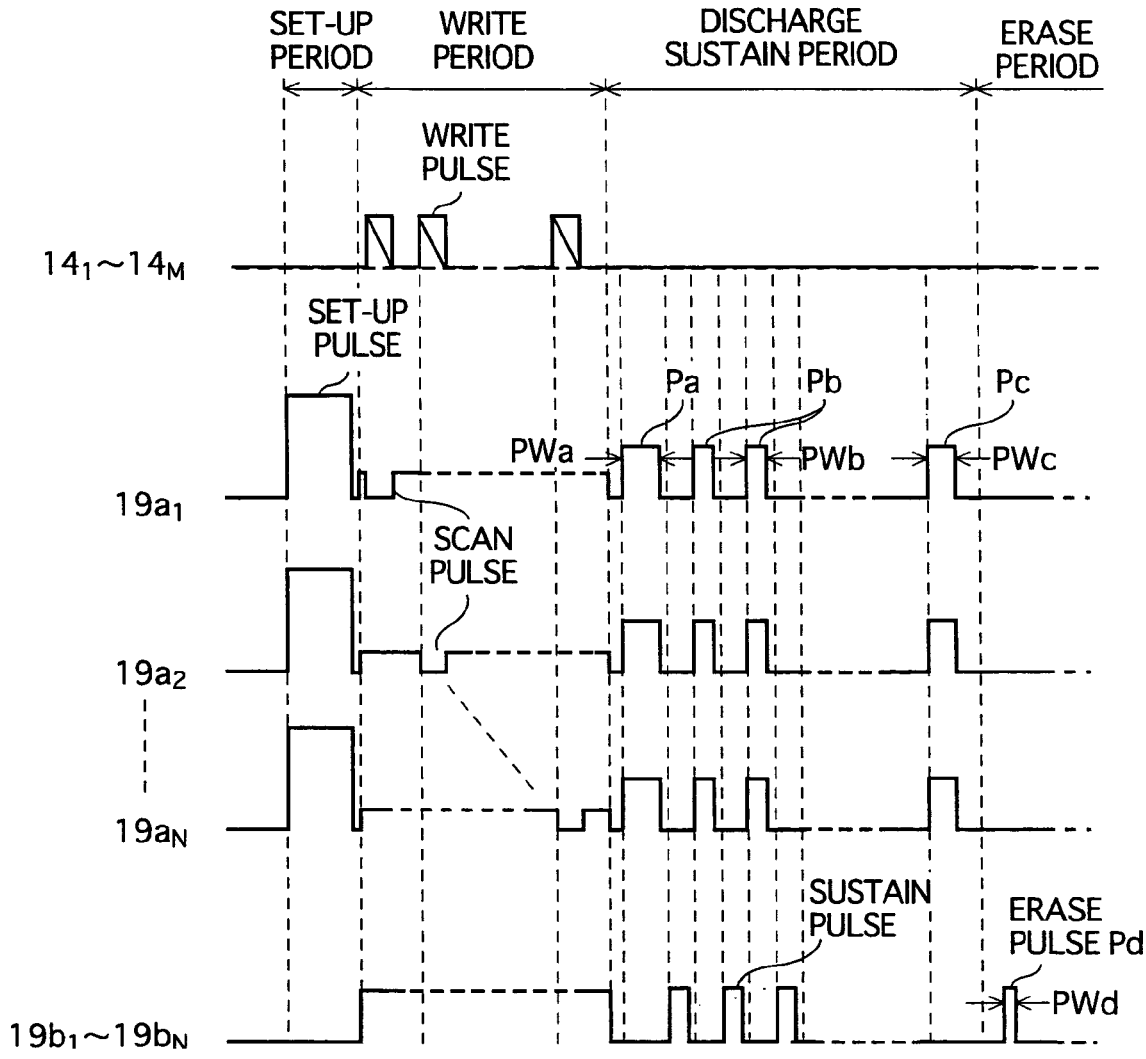
FIG. 5 is a time chart showing pulses applied to each type of electrode during one sub-field.

FIG. 5 is a time chart showing pulses applied to each type of electrode during one sub-field.

In the set-up period, the set-up pulse is applied to each of the scan electrodes 19*a*, to initialize wall charges in all of the discharge cells.

In the write period, while the scan pulse is sequentially applied to each of the scan electrodes 19*a*, the write pulse is applied to electrodes selected from the data electrodes $\mathbf{14}_1$ to $\mathbf{14}_M$. This causes wall charges to accumulate in the discharge cells to be lit, writing one-screen pixel data (a latent image).

In the discharge sustain period, the data electrodes $\mathbf{14}_1$ to $\mathbf{14}_M$ are earthed, and the sustain pulse is alternately applied to the scan electrodes 19*a* and the sustain electrodes 19*b*. This causes a main discharge in the discharge cells in which wall charges have accumulated to sustain during the discharge sustain period, to emit light.

In the erase period, a narrow pulse $P_d$ (having a pulse width $PW_d$ of 500 ns) that has a rectangular waveform and a height of no more than a discharge firing voltage is collectively applied, as the erase pulse, to all of the sustain electrodes 19*b*. This discontinues an erase discharge, to reduce the wall charges in the discharge cells. According to this method, the voltage of the narrow pulse $P_d$ can be almost the same as that of the sustain pulse. Accordingly, power consumption is reduced when compared with the case of applying a voltage no less than the discharge firing voltage. In addition, wall voltages in the discharge cells are not fully erased because the erase discharge is discontinued before wall charges are reversed and then accumulate sufficiently. Accordingly, a certain amount of wall voltages having the same polarity as the set-up pulse applied in the subsequent set-up period remains in the discharge cells. This makes it easy to perform the set-up discharge. As a result, the voltage of the write pulse applied in the write period can be lowered, and an erroneous discharge can be suppressed. Note that the pulse width $PW_d$ of the narrow pulse is not limited to the above-mentioned value. The pulse width $PW_d$ in a range of 200 ns to 2 μs also enables the present invention to be realized.

Characteristics of the Waveform Used for the Sustain Pulse and the Effects Obtained by the Used of Such Waveform A pulse applied in the later part of the discharge sustain period has a larger width, in absolute value, than a pulse applied in the earlier part of the discharge sustain period (except for a pulse applied at the start of the discharge sustain period). Here, it is assumed that the sustain pulse has positive polarity, although the same applies to a negative-polarity pulse. The pulses applied to the scan electrodes 19*a* in the discharge sustain period are exchangeable with the pulses applied to the sustain electrodes 19*b* in the discharge sustain period.

As shown in FIG. 5, in the discharge sustain period, a pulse $P_a$ that has a large pulse width $PW_a$ (around 20 μs) and a rectangular waveform is first collectively applied to all of the scan electrodes 19*a*. Here, a pulse width is a width from a point where a pulse has risen 10% of a pulse height thereof to a point where the pulse has fallen 10% of the pulse height from the pulse height. At the beginning of the discharge sustain period, the discharge cells are inactive, which results in considerable discharge delay. However, if the pulse $P_a$ is first applied in the discharge sustain period, the sustain discharge is reliably performed, and thereby the wall voltages in the discharge cells are raised to a high level.

After the pulse $P_a$, a pulse $P_b$ having a pulse width $PW_b$ (around 2 μs) is repeatedly applied to the scan electrodes 19*a* and the sustain electrodes 19*b* alternately. Since the pulse $P_a$ that is first applied has raised the wall voltages in the discharge cells to a high level, the pulse $P_b$ that is applied alternately enables the sustain discharge to be performed stably and successively.

A pulse $P_c$ having a pulse width $PW_c$ (around 4 μs) is lastly applied collectively to all of the scan electrodes 19*a*.

The pulse width $PW_c$ of the pulse $P_c$ is larger than the pulse width $PW_b$ of the pulse $P_b$ by 2 μs. The pulse $P_b$ represents a pulse applied in the discharge sustain period, except for the pulse $P_a$. In the background art, all of the pulses applied in the discharge sustain period, except for the pulse $P_a$, have the same pulse width of $PW_b$. However, the pulse width of the final pulse in the discharge sustain period is widened in the present embodiment, and the discharge generated by the pulse $P_c$ is stronger than the discharge generated by the pulse $P_b$. As a result, the wall voltages.in the discharge cells observed at the end of the discharge sustain period are raised to a higher level than in the related art. Moreover, an experiment has proved that the application of the pulse $P_c$ having a large pulse width causes the wall voltages in the discharge cells to be equalized. When the narrow pulse that has a height no more than the discharge firing voltage is used as the erase pulse, the erase discharge may not performed sufficiently, if the wall voltages in the discharge cells at the end of the discharge sustain period are low. This may generate an erroneous discharge. According to the present embodiment, however, the pulse $P_c$ raises the wall voltages in the discharge cells to a high level as described above. Therefore, even when the narrow pulse that has a height no more than the discharge firing voltage is applied in the erase period, the erase discharge is performed properly. This reduces the occurrence of an erroneous discharge in the plasma display apparatus, when compared with the related art. Therefore, a drop in image quality is suppressed, and the voltage applied for generating the write discharge is kept low. In addition, the pulse width of the pulse $P_b$ that is repeatedly applied in the discharge sustain period is narrowed, and the pulse width of the pulse $P_c$ that is applied only once is widened. This means that the discharge sustain period can be made shorter than in the related art, without causing an erroneous discharge to occur.

Here, the difference between $PW_c$ and $PW_b$ ($PW_c$-$PW_b$) is 2 μs in a first embodiment, but not limited to such. When the difference is within a range of 0.5 μs to 20 μs, the same result as the first embodiment can be obtained. If the difference between $PW_c$ and $PW_b$ is less than 0.5 μs, the wall voltages in the discharge cells can not be raised to a sufficiently high level. On the other hand, the difference exceeding 20 μs causes the wall voltages to saturate.

In the first embodiment, the pulse width of the final sustain pulse in the discharge sustain period is widened so as to be larger than that of the sustain pulse $P_b$. Here, the pulse $P_b$ (hereinafter referred to as an intermediate sustain pulse) represents the sustain pulses applied between the initial and the final sustain pulses. However, it is not necessarily the final sustain pulse whose pulse width is widened.

Figure 6:
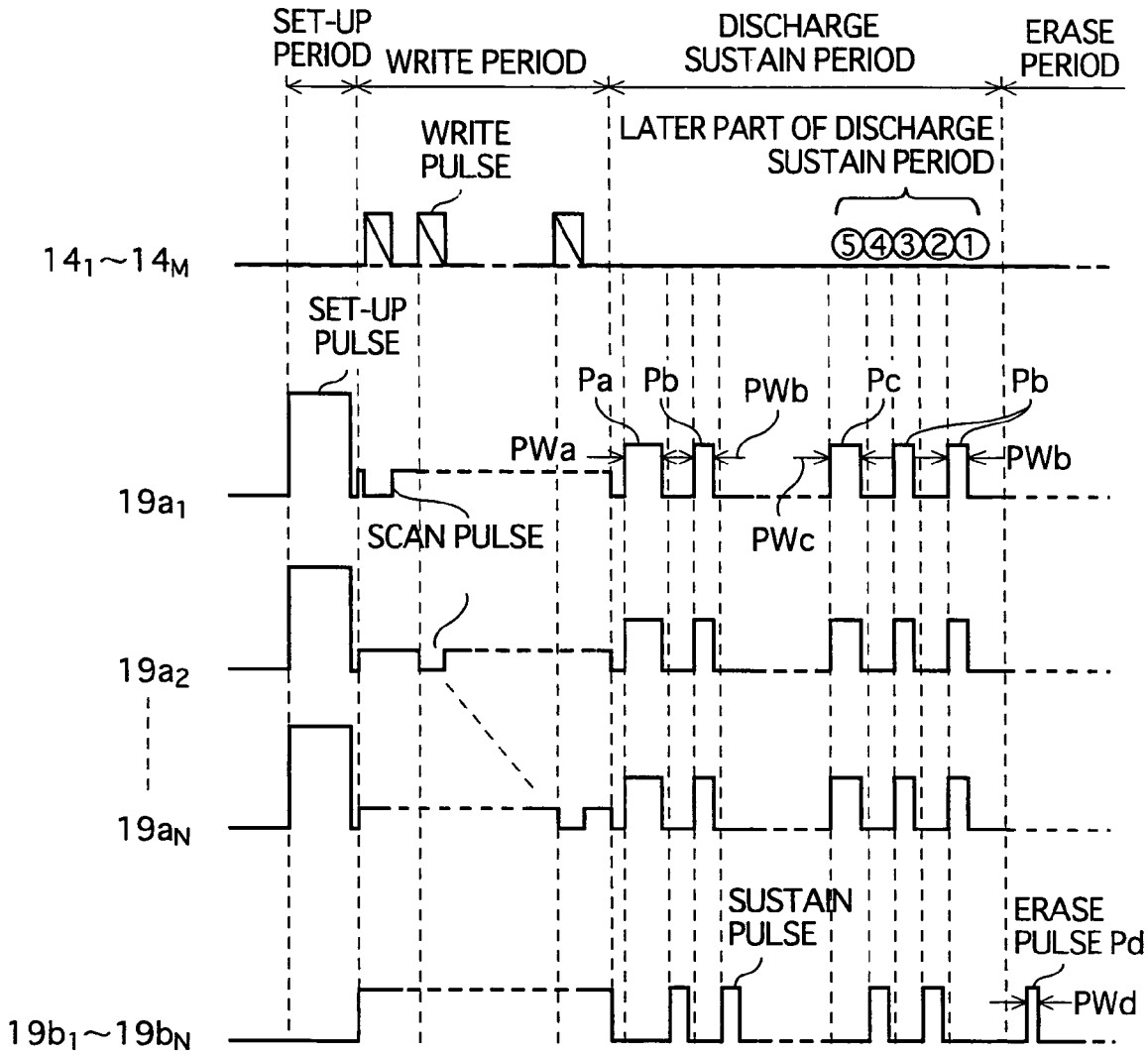
FIG. 6 is a time chart showing pulses applied to each type of electrode during one sub-field.

FIG. 6 is a time chart showing pulses applied to each type of electrode in one sub-field.

As shown in FIG. 6, the pulse width of the fifth last sustain pulse in the discharge sustain period is larger than that of the intermediate sustain pulse which is applied in the earlier part before the later part of the discharge sustain period. Here, the later part of the discharge sustain period starts at the point where the fifth last sustain pulse is applied. An experiment has confirmed that this modification also raises the wall voltages observed at the end of the discharge sustain period to a higher level than in the related art. Accordingly, the occurrence of erroneous discharge in the plasma display apparatus is suppressed. Note that it can be any of the last five sustain pulses that the pulse width thereof is widened. Here, when the sustain pulse whose width is widened is closer to the end of the discharge sustain period, the wall voltages are raised more effectively. It is even more effective to widen the pulse width of more than one sustain pulses out of the last five sustain pulses. Here, if widening a pulse that precedes the last five pulses has an effect of raising the wall voltages in the discharge cells at the end of the discharge sustain period to a higher level than in the related art, the later part of the discharge sustain period is considered to start at the point where the pulse with the widened pulse width is applied. The pulse $P_c$ may not be employed in all of the sub-fields for one field, but only in a sub-field in which the later part of the discharge sustain period starts long time after the application of the pulse $P_a$, in other words, in a sub-field having a large luminance weight in which the wall voltages generated by the pulse $P_a$ tend to decrease.

There is no particular limitation for the width $PW_a$ of the pulse $P_a$, which is applied at the start of the discharge sustain period. The pulse width $PW_a$ may be the same as or smaller than the pulse width $PW_b$ of the intermediate sustain pulse $P_b$.

Experiment

Regarding plasma display apparatuses relating to the first embodiment (embodiment examples 1-1 and 1-2) and conventional plasma display apparatuses (comparative examples 1-1 and 1-2), the pulse width of the intermediate sustain pulse and that of the final sustain pulse were set at various values. Here, the generation probability of the erase discharge in the erase period and the presence of an erroneous discharge observed in each example were examined. The results are shown in Table 1.

TABLE 1

| | Intermediate sustain pulse width [μs] | Final sustain pulse width [μs] | Erase discharge probability [%] | Erroneous discharge |
|---|---|---|---|---|
| Comparative Example 1-1 | 4 | 4 | 94.80 | Present |
| Comparative Example 1-2 | 6 | 6 | 99.95 | Absent |
| Embodiment Example 1-1 | 4 | 6 | 99.90 | Absent |
| Embodiment Example 1-2 | 5 | 6 | 99.90 | Absent |

As for the comparative examples 1-1 and 1-2, shortening the pulse width of the intermediate sustain pulse from 6 μs (comparative example 1-2) to 4 μs (comparative example 1-1) causes a decrease of around 5% in the erase discharge probability. In addition, this induces an erroneous discharge.

On the other hand, comparing the embodiment examples 1-1 and 1-2, shortening the pulse width of the intermediate sustain pulse to 4 μs (embodiment example 1-1) does not reduce the erase discharge probability. Besides, an erroneous discharge is not generated. The probable reason for this is explained in the following part. Since the final sustain pulse in the discharge sustain period is widened, the wall voltages in the discharge cells observed at the end of the discharge sustain period are raised to a high level. This increases the generation probability of the erase discharge in the subsequent erase period. Accordingly, the erase discharge is securely performed, enabling the erase operation to be stabilized. As a result, an erroneous discharge generated in the PDP is suppressed.

Second Embodiment

The above-mentioned first embodiment uses the narrow pulse having a rectangular waveform for the erase pulse. A second embodiment is different from the first embodiment in that a pulse which has a ramp waveform is used for the erase pulse. The rising portion of such pulse has a gentle gradient. The second embodiment will be described with a focus on its difference from the second embodiment.

Figure 7:
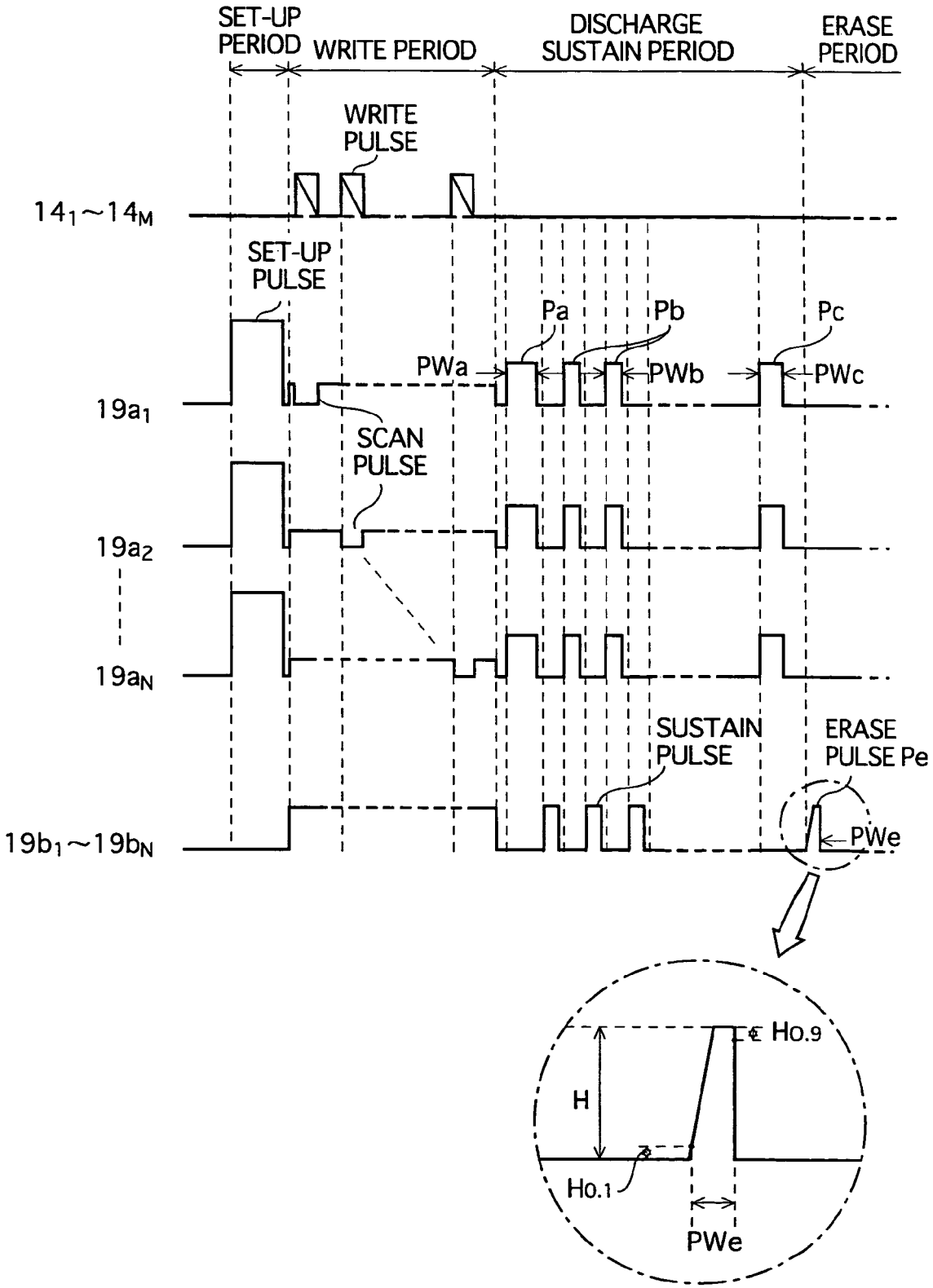
FIG. 7 is a time chart showing pulses applied to each type of electrode during one sub-field in a second embodiment.

FIG. 7 is a time chart showing pulses applied to each type of electrode during one sub-field in the second embodiment.

As shown in FIG. 7, the sustain pulses applied in the discharge sustain period in the second embodiment are the same as those in the first embodiment which is described in FIG. 5. Needless to say, the sustain pulses in the second embodiment may be the same as those shown in FIG. 6, in which any of the sustain pulses applied in the later part of the discharge sustain period is wider than the intermediate sustain pulse. Also, a ramp waveform is used for the erase pulse $P_e$ applied in the erase period.

The ramp waveform rises linearly at a gentle gradient, remains at a height H for a given time period, and falls vertically. Here, the height H is approximately equal to the voltage of the sustain pulse, that is, no more than the discharge firing voltage. The pulse width $PW_e$ of the pulse $P_e$ is 500 ns, and indicates a time period from $H_{0.1}$ to $H_{0.9}$ as shown in the enlarged figure in FIG. 7. Here, $H_{0.1}$ indicates the point where the pulse has risen by 10% of the maximum height H of the pulse, and $H_{0.9}$ where the pulse has fallen from the maximum height H by 10% of the maximum height H. The pulse width $PW_e$ is smaller than the pulse width of the intermediate sustain pulse $P_b$. The pulse width $PW_e$ is not necessarily as small as the above value, but the pulse height of the pulse $P_e$ must be no more than the discharge firing voltage.

When the above-mentioned ramp waveform is used for the erase pulse, the change in the voltage applied to the discharge cells in the rising portion is gentle relative to the elapsed time period. This causes a weak discharge to occur continuously in the discharge cells, thereby keeping the wall voltages at a level slightly lower than the discharge firing voltage in the discharge cells. Accordingly, under the condition that the intermediate sustain pulse has a sufficient width of around 6 μs as in the related art to raise the wall voltages at the end of the discharge sustain period to a high level, the application of the above-mentioned ramp waveform in the erase period enables a discharge delay time $t_{de}$ to be shortened. The discharge delay time $t_{de}$ is the time period from when the erase pulse is applied to when the erase discharge is actually performed.

However, the width of the sustain pulse is shortened to achieve high-speed driving in accordance with PDPs having high definition. Here, shortening the width of the sustain pulse lowers the wall voltages observed at the end of the discharge sustain period, thereby increasing the discharge delay time $t_{de}$ in the erase period. As a result, the effective time period for the erase discharge is decreased, which enables the erase operation to be performed reliably.

In the second embodiment, however, high wall voltages are achieved in the discharge cells at the end of the discharge sustain period, as described in the first embodiment. This makes it easy to perform the erase discharge in the following erase period. As a consequence, the discharge delay time $t_{de}$ in the erase period is shortened when compared with the first embodiment, to perform the erase operation reliably.

Experiment

Regarding plasma display apparatuses relating to the second embodiment (embodiment examples 2-1 and 2-2) and conventional plasma display apparatuses (comparative examples 2-1 and 2-2), the pulse width of the intermediate sustain pulse and that of the final pulse were set at various values. Here, the discharge delay time in the erase period and the presence of an erroneous discharge in each example were examined, and the results are shown in Table 2.

TABLE 2

| | Intermediate sustain pulse width [μs] | Final sustain pulse width [μs] | Discharge delay time $t_{de}$ [μs] | Erroneous discharge |
|---|---|---|---|---|
| Comparative Example 2-1 | 4 | 4 | 8.5 | Present |
| Comparative Example 2-2 | 6 | 6 | 8.0 | Absent |
| Embodiment Example 2-1 | 4 | 6 | 8.1 | Absent |
| Embodiment Example 2-2 | 5 | 6 | 8.0 | Absent |

As for the comparative examples 2-1 and 2-2, shortening the width of the intermediate sustain pulse from 6 μs (the comparative example 2-2) to 4 μs (the comparative example 2-1) increases the discharge delay time by approximately 6%, and also causes an erroneous discharge to occur.

As for the embodiment examples 2-1 and 2-2, however, shortening the width of the intermediate sustain pulse to 4 μs (the embodiment example 2-1) induces little increase in the discharge delay time and causes no erroneous discharge. The probable reason for this is stated in the following. Since the final sustain pulse is widened, the wall voltages in the discharge cells at the end of the discharge sustain period are raised to a high level. This makes it easy to perform the erase discharge in the subsequent erase period. In addition, the use of the ramp waveform for the erase pulse reduces the discharge delay. This allows a long discharge time in the erase period, to perform the erase operation reliably. As a result, the erase operation is stabilized, and an erroneous discharge is suppressed in the PDP.

The difference in pulse width between the intermediate sustain pulse and the final sustain pulse (the pulse(s) applied in the later part of the discharge sustain period) is 1 μs or 2 μs in this experiment, but not limited thereto. The above difference can be set within a range from 0.5 μs to 20 μs. This is because the difference of less than 0.5 μs can not raise the wall voltages in the discharge cells to a sufficiently high level, and the difference exceeding 20 μs causes the wall voltages to saturate.

Also, the pulse width $PW_e$ of the erase pulse is 500 ns in this experiment, but not limited to such. The pulse width $PW_e$ can be set within a range from 200 ns to 2 μs.

Third Embodiment

In the above-described first and second embodiments, every sub-field in one field includes the set-up period. A third embodiment is different from the above embodiments in that one field includes only one set-up period, prior to the first sub-field. In other words, in one field, one set-up period is followed by a plurality of sub-fields each including the write period, the discharge sustain period, and the erase period. When every sub-field has the set-up period as in the related art, the contrast of the PDP tends to drop because of light emission caused when the set-up discharge is performed. To suppress the drop in contrast, lowering luminance when displaying black by reducing the number of set-up discharges has been attempted. However, the omission of the set-up period from the sub-field poses the following problem. The wall voltages accumulated by a discharge generated in the sub-field that precedes the current sub-field tend to cause an erroneous discharge to occur. To prevent such erroneous discharge, the erase operation must be reliably performed in the erase period of each sub-field. However, if the width of the sustain pulse is shortened to realize a PDP having high definition, the erase operation becomes unstable. Accordingly, considerable drop in image quality is caused because of an increase in erroneous discharge.

Figure 8:
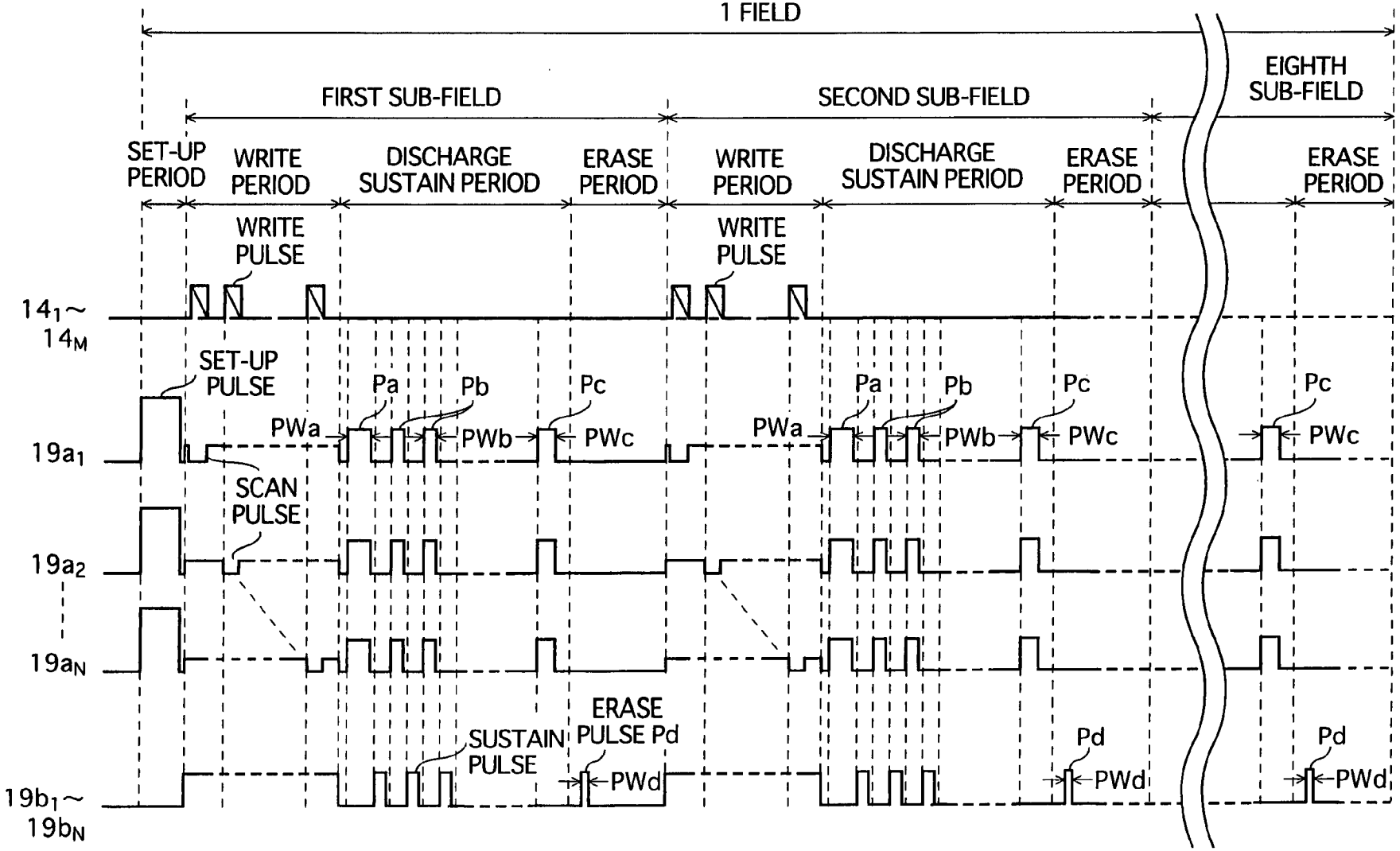
FIG. 8 is a time chart showing pulses applied to each type of electrode during one field in a third embodiment.

FIG. 8 is a time chart showing pulses applied to each type of electrode during one field in the third embodiment.

As shown in FIG. 8, one set-up period is provided at the start of each field, and followed by sub-fields each of which only includes the write period, the discharge sustain period, and the erase period. Here, the set-up pulses applied in the set-up period in the third embodiment are the same as those shown in FIG. 5. The driving waveform applied in each sub-field in the first embodiment (shown in FIG. 5), excluding the portion of the set-up period, is employed for the driving waveform applied in each sub-field in the third embodiment. Needless to say, the driving waveform shown in FIG. 6, in which the width of any of the sustain pulses applied in the later part of the discharge sustain period is larger than that of the intermediate sustain pulse, can be also employed.

According to this method, despite the omission of the set-up period from each sub-field, the wall voltage in each of the discharge cells at the end of the discharge sustain period is raised to a high level, as in the first and the second embodiments. This enables the erase operation to be performed reliably in the subsequent erase period, thereby suppressing the occurrence of an erroneous discharge and reducing the number of the set-up discharges. As a consequence, image quality and contrast of the PDP are improved. Regarding the discharge sustain period, the width of the pulse $P_b$ that is applied repeatedly is shortened, and the width of the pulse $P_c$ that is applied only once is widened as in the first embodiment. This makes the discharge sustain period shorter than in the related art, without causing an erroneous discharge to occur.

Here, each sub-field has the erase period in the third embodiment, but the present invention is not limited to such. As an alternative, the erase period which is arranged at the end of each sub-field may be replaced with a discharge pause period in which a voltage of 0V is applied to all of the electrodes, so that more than one sub-fields emit light because of the writing operation performed in the write period of one sub-field in one field. According to this alternative driving method, an erroneous discharge can be also suppressed for the reasons mentioned above. It is also possible to use a ramp waveform that has a gradual rising portion for the erase pulse applied in the erase period, as in the second embodiment. This also secures a long discharge time period, enabling the erase operation to be performed reliably.

Experiment

Regarding plasma display apparatuses relating to the third embodiment (embodiment examples 3-1 and 3-2) and conventional plasma display apparatuses (comparative examples 3-1 and 3-2), the pulse width of the intermediate sustain pulse and that of the final sustain pulse were set at various values. Here, the discharge delay time in the erase period and the presence of an erroneous discharge in the PDP in each example were examined. The results are shown in Table 3.

TABLE 3

| | Intermediate sustain pulse width [μs] | Final sustain pulse width [μs] | Erase discharge probability [%] | Erroneous discharge |
|---|---|---|---|---|
| Comparative Example 3-1 | 4 | 4 | 89.60 | Present |
| Comparative Example 3-2 | 6 | 6 | 99.92 | Absent |
| Embodiment Example 3-1 | 4 | 6 | 99.03 | Absent |
| Embodiment Example 3-2 | 5 | 6 | 99.17 | Absent |

As for the comparative examples 3-1 and 3-2, shortening the width of the intermediate sustain pulse from 6 μs (the comparative example 3-2) to 4 μs (the comparative example 3-1) causes a decrease of around 11% in the erase discharge generation probability and the occurrence of an erroneous discharge.

As for the embodiment examples 3-1 and 3-2, on the other hand, shortening the width of the intermediate sustain pulse to 4 μs (the embodiment example 3-1) causes little decrease in the erase discharge generation probability and no erroneous discharge. The probable reason for this is explained in the following part. Since the final sustain pulse in the discharge sustain period is widened, the wall voltages in the discharge cells at the end of the discharge sustain period are raised to a high level. This makes it easy to perform the erase discharge in the subsequent erase period. In addition, since the set-up discharge is performed only once in each field, the number of sub-fields can be increased, to improve the contrast of the PDP.

Note that the difference in pulse width between the intermediate sustain pulse and the final sustain pulse (pulse(s) applied in the later part of the discharge sustain period) is set 1 μs or 2 μs in this experiment, but not limited to such. The same results as the third embodiment can be obtained when the above difference is in a range of 0.5 μs to 20 μs. When the difference is less than 0.5 μs, the wall voltages in the discharge cells can not be raised to a sufficiently high level, and the difference exceeding 20 μs causes the wall voltages to saturate.

The pulse width of the erase pulse can be set within a range from 200 ns to 2 μs, as in the first and the second embodiments.

Fourth Embodiment

A rectangular wave form is used for the set-up pulse applied in the set-up period in the above third embodiment. A fourth embodiment is different from the third embodiment in that a ramp waveform is used for the set-up pulse applied in the set-up period and a two-step staircase waveform is used for the erase pulse applied in the erase period. The following part describes the fourth embodiment with a focus of its difference from the third embodiment.

The use of a rectangular waveform for the set-up pulse causes the voltage to rise and fall suddenly. This causes a strong discharge to occur, and thereby prevents wall charges from accumulating. Accordingly, the discharge delay time $t_{de}$ of the write discharge performed in the write period may be increased. Accordingly, the write discharge can not be performed sufficiently, which makes an erroneous discharge likely.

Figure 9:
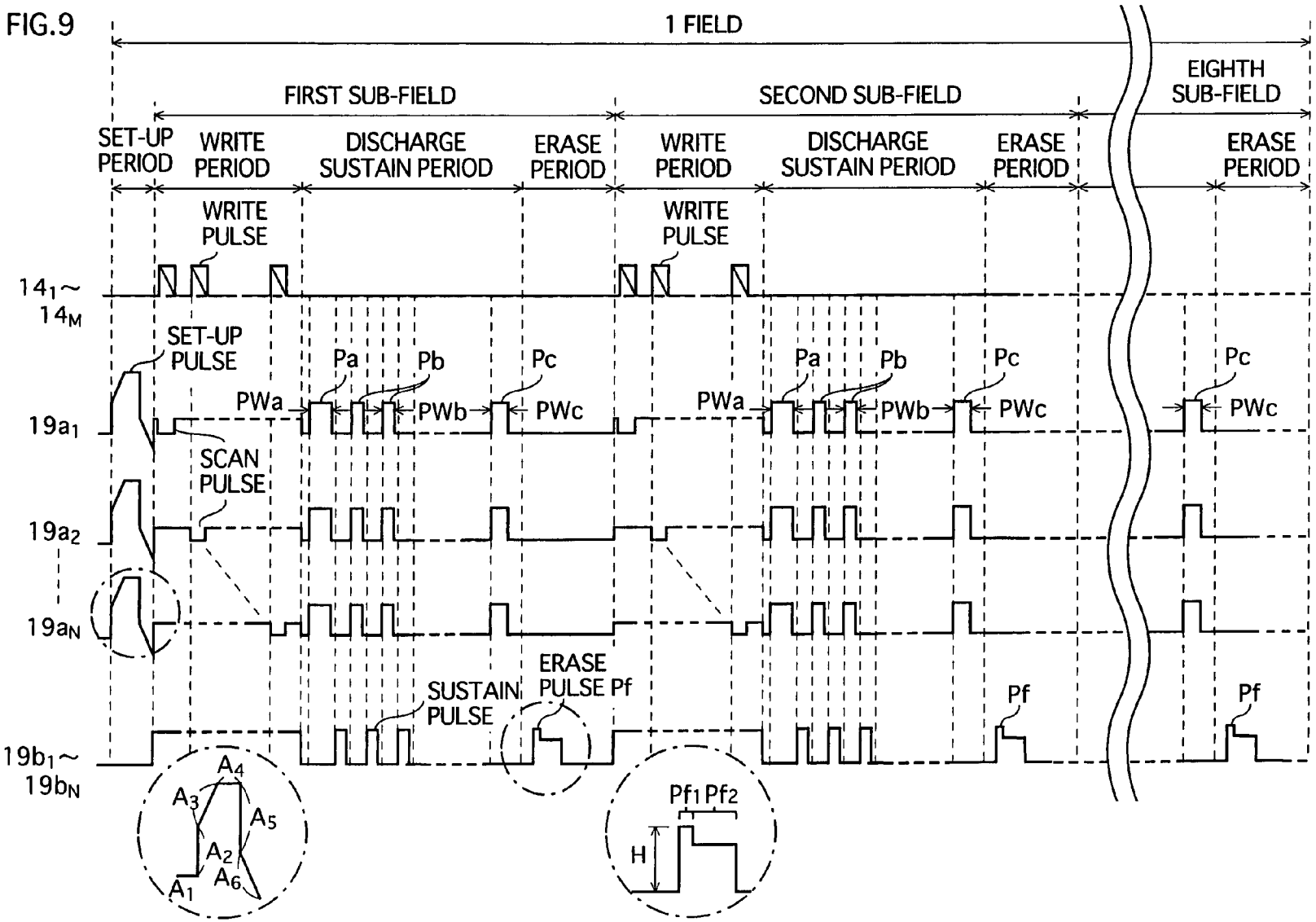
FIG. 9 is a time chart showing pulses applied to each type of electrode during one field in a fourth embodiment.

FIG. 9 is a time chart showing a driving pulse relating to the fourth embodiment.

As shown in FIG. 9, the set-up pulse relating to the fourth embodiment has six portions, $A_1$ to $A_6$. Since each portion of such set-up pulse and a driving circuit for generating such set-up pulse are, in detail, mentioned in Japanese laid-open patent application publication No. 2000-267625, the set-up pulse relating to the fourth embodiment is only briefly described here.

To prevent a strong discharge from occurring, the rising portion of the set-up pulse has a gradual rising portion $A_3$ in which the voltage is raised slowly. For the same reason, the falling portion has a gradual falling portion $A_6$ in which the voltage is lowered slowly. With such waveform, a weak discharge continuously occurs. Therefore, the use of the above ramp waveform does not induce a strong discharge, and thereby causes more wall charges to accumulate, when compared with the use of a rectangular waveform. Accordingly, the discharge delay time of the write discharge generated in the following write period can be shortened. This enables the write discharge to be performed reliably, thereby performing the sustain discharge reliably. In addition, as a strong discharge is not generated in the set-up period, light emission caused by the set-up discharge is decreased. This improves the contrast of the PDP when compared to the third embodiment.

Also, in the discharge sustain period, a pulse that is applied in the later part of the discharge sustain period has a larger pulse width than the intermediate sustain pulse as in the above embodiments. This raises the wall voltage in each of the discharge cells at the end of the discharge sustain period to a high level.

The following part describes the erase pulse relating to the fourth embodiment.

As shown in FIG. 9, the erase pulse relating to the fourth embodiment has two parts; a narrow-pulse part $P_{f1}$ and a wide-pulse part $P_{f2}$. In the narrow-pulse part $P_{f1}$, the voltage is maintained at a level close to the discharge firing voltage (approximately equal to a discharge sustain voltage). In the wide-pulse part $P_{f2}$, the voltage is maintained at a level lower than the height of the narrow-pulse part $P_{f1}$.

The narrow-pulse part $P_{f1}$ has the same width as the erase pulse relating to each of the above embodiments. Therefore, the erase discharge is discontinued halfway, before wall charges are reversed and accumulate sufficiently. In other words, the wall voltages in the discharge cells are not completely erased, and a certain amount of wall voltages having the same polarity as the set-up pulse applied in the subsequent set-up period remains. Also, in the wide-pulse part $P_{f2}$, the voltage is maintained at a level lower than the discharge firing voltage but higher than 0V, so as to equalize the wall voltages in the discharge cells to a certain extent. As a consequence, the use of the erase pulse relating to the fourth embodiment makes it easier to perform the set-up discharge, when compared with the use of the narrow pulse for the erase pulse. Here, as in the above embodiments, the wall voltages observed at the end of the discharge sustain period are raised to a higher level than in the related art and also equalized. This enables the erase discharge to be performed more reliably. As a consequence, the occurrence of an erroneous discharge is suppressed, and the amount of light emitted during the set-up period is reduced in the plasma display apparatus relating to the fourth embodiment, which improves the contrast in the plasma display apparatus.

INDUSTRIAL APPLICABILITY

The plasma display apparatus of the present invention is particularly applicable to a plasma display apparatus having high definition.

The invention claimed is:

1. A plasma display apparatus comprising:

a plasma display panel in which a plurality of discharge cells are formed between a pair of substrates, and a pair of electrodes extend across each of the plurality of discharge cells; and a driving circuit that drives the plasma display panel in such a manner that one field is divided into a plurality of sub-fields, each of the plurality of sub-fields including (i) a write period in which writing is performed in discharge cells selected from the plurality of discharge cells, (ii) a discharge sustain period in which pulses are applied to the pair of electrodes extending across each of the plurality of discharge cells, to perform a discharge in the selected discharge cells in which the writing has been performed in the write period, and (iii) an erase period in which the discharge that has been performed in the selected discharge cells in the discharge sustain period is discontinued, wherein in the discharge sustain period, at least one of a plurality of pulses applied in a later part of the discharge sustain period has a larger pulse width than a pulse applied in an earlier part of the discharge sustain period, and in the erase period, a narrow pulse is applied to the pair of electrodes extending across each of the plurality of discharge cells, the narrow pulse having a smaller pulse width than the pulses applied in the discharge sustain period, wherein a difference in pulse width between (i) the at least one pulse in the later part of the discharge sustain period and (ii) other pulses applied in the discharge sustain period, except for an initial pulse applied in the discharge sustain period, is in a range of 0.5 μs to 20 μs.

2. The plasma display apparatus of claim 1, wherein the later part of the discharge sustain period starts at a point where a fifth last pulse is applied in the discharge sustain period.

3. The plasma display apparatus of claim 2, wherein a final pulse applied in the later part of the discharge sustain period has a larger pulse width than the pulse applied in the earlier part of the discharge sustain period.

4. The plasma display apparatus of claim 1, wherein the narrow pulse that is applied in the erase period is no less than 200 ns but less than 2 μs in width.

5. The plasma display apparatus of claim 1, wherein in the erase period, after the narrow pulse is applied, a wide pulse having a lower pulse height and a larger pulse width than the narrow pulse is applied to the pair of electrodes.

6. A plasma display apparatus comprising:

a plasma display panel in which a plurality of discharge cells are formed between a pair of substrates, and a pair of electrodes extend across each of the plurality of discharge cells; and a driving circuit that drives the plasma display panel in such a manner that one field is divided into a plurality of sub-fields, each of the plurality of sub-fields including (i) a write period in which writing is performed in discharge cells selected from the plurality of discharge cells, (ii) a discharge sustain period in which pulses are applied to the pair of electrodes extending across each of the plurality of discharge cells, to perform a discharge in the selected discharge cells in which the writing has been performed in the write period, and (iii) an erase period in which the discharge that has been performed in the selected discharge cells in the discharge sustain period is discontinued, wherein in the discharge sustain period, at least one of a plurality of pulses applied in a later part of the discharge sustain period has a larger pulse width than a pulse applied in an earlier part of the discharge sustain period, and in the erase period, a pulse which has a gradual rising portion is applied to the pair of electrodes extending across each of the plurality of discharge cells, wherein a difference in pulse width between (i) the at least one pulse in the later part of the discharge sustain period and (ii) other pulses applied in the discharge sustain period, except for an initial pulse applied in the discharge sustain period, is in a range of 0.5 μs to 20 μs.

7. A plasma display apparatus comprising:

a plasma display panel in which a plurality of discharge cells are formed between a pair of substrates, and a pair of electrodes extend across each of the plurality of discharge cells; and a driving circuit that drives the plasma display panel by using a sub-field that includes (i) a write period in which writing is performed in discharge cells, (ii) a discharge sustain period in which pulses are applied to the pair of electrodes extending across each of the plurality of discharge cells, to perform a discharge in the selected discharge cells in which the writing has been performed in the write period, and (iii) an erase period in which the discharge that has been performed in the selected discharge cells in the discharge sustain period is discontinued, wherein in the discharge sustain period, an initial pulse and a final pulse have a larger pulse width than a pulse that is applied between the initial pulse and the final pulse, in the erase period, a narrow pulse is applied to the pair of electrodes extending across each of the plurality of discharge cells, the narrow pulse having a smaller pulse width than the pulses applied in the discharge sustain period, and a difference in pulse width between (i) the final pulse and (ii) the pulse applied between the initial pulse and the final pulse is in a range of 0.5 μs to 20 μs.

8. The plasma display apparatus of claim 7, wherein in the discharge sustain period, the pulses are applied to a scan electrode, and in the erase period, the narrow pulse is applied to a sustain electrode.

9. The plasma display apparatus of claim 7, wherein the narrow pulse applied in the erase period is no less than 200 ns but less than 20 μs.

10. A plasma display apparatus comprising:

a plasma display panel in which a plurality of discharge cells are formed between a pair of substrates, and a pair of electrodes extend across each of the plurality of discharge cells; and a driving circuit that drives the plasma display panel by using a sub-field that includes (i) a write period in which writing is performed in discharge cells selected from the plurality of discharge cells, (ii) a discharge sustain period in which pulses are applied to the pair of electrodes extending across each of the plurality of discharge cells, to perform a discharge in the selected discharge cells in which the writing has been performed in the write period, and (iii) an erase period in which the discharge that has been performed in the selected discharge cells in the discharge sustain period is discontinued, wherein in the discharge sustain period, an initial pulse and a final pulse have a larger pulse width than a pulse that is applied between the initial pulse and the final pulse, and in the erase period, a pulse which has a gradual rising portion is applied to the pair of electrodes extending across each of the plurality of discharge cells, wherein a difference in pulse width between (i) the at least one pulse in the later part of the discharge sustain period and (ii) other pulses applied in the discharge sustain period, except for an initial pulse applied in the discharge sustain period, is in a range of 0.5 μs to 20 μs.

11. The plasma display apparatus of claim 10, wherein in the discharge sustain period, the pulses are applied to a scan electrode, and in the erase period, the pulse is applied to a sustain electrode.

12. The plasma display apparatus of claim 1, wherein the sub-field includes, prior to the write period, a set-up period in which a pulse is applied to the pair of electrodes to equalize wall charges in the plurality of discharge cells.

13. The plasma display apparatus of claim 1, wherein one field has only one set-up period in which a pulse is applied to the pair of electrodes to initialize the plurality of discharge cells.

14. The plasma display apparatus of claim 13, wherein the pulse applied in the set-up period has a gradual rising portion and a gradual falling portion.

15. The plasma display apparatus of claim 13, wherein the pulse applied in the set-up period has a gradual rising portion and a gradual falling portion, and a minimum voltage in a falling portion of the pulse has a negative polarity.

16. The plasma display apparatus of claim 2, wherein in the erase period, after the narrow pulse is applied, a wide pulse having a lower pulse height and a larger pulse width than the narrow pulse is applied to the pair of electrodes.

17. The plasma display apparatus of claim 3, wherein in the erase period, after the narrow pulse is applied, a wide pulse having a lower pulse height and a larger pulse width than the narrow pulse is applied to the pair of electrodes.

18. The plasma display apparatus of claim 1, wherein in the erase period, after the narrow pulse is applied, a wide pulse having a lower pulse height and a larger pulse width than the narrow pulse is applied to the pair of electrodes.

19. The plasma display apparatus of claim 4, wherein in the erase period, after the narrow pulse is applied, a wide pulse having a lower pulse height and a larger pulse width than the narrow pulse is applied to the pair of electrodes.

20. The plasma display apparatus of claim 7, wherein a difference in pulse width between (i) the final pulse and (ii) the pulse applied between the initial pulse and the final pulse is in a range of 0.5 μs to 20 μs.

21. The plasma display apparatus of claim 8, wherein the narrow pulse applied in the erase period is no less than 200 ns but less than 2 μs.

22. The plasma display apparatus of claim 7, wherein the narrow pulse applied in the erase period is no less than 200 ns but less than 2 μs.

23. The plasma display apparatus of claim 2, wherein the sub-field includes, prior to the write period, a set-up period in which a pulse is applied to the pair of electrodes to equalize wall charges in the plurality of discharge cells.

24. The plasma display apparatus of claim 3, wherein the sub-field includes, prior to the write period, a set-up period in which a pulse is applied to the pair of electrodes to equalize wall charges in the plurality of discharge cells.

25. The plasma display apparatus of claim 1, wherein the sub-field includes, prior to the write period, a set-up period in which a pulse is applied to the pair of electrodes to equalize wall charges in the plurality of discharge cells.

26. The plasma display apparatus of claim 4, wherein the sub-field includes, prior to the write period, a set-up period in which a pulse is applied to the pair of electrodes to equalize wall charges in the plurality of discharge cells.

27. The plasma display apparatus of claim 5, wherein the sub-field includes, prior to the write period, a set-up period in which a pulse is applied to the pair of electrodes to equalize wall charges in the plurality of discharge cells.

28. The plasma display apparatus of claim 6, wherein the sub-field includes, prior to the write period, a set-up period in which a pulse is applied to the pair of electrodes to equalize wall charges in the plurality of discharge cells.

29. The plasma display apparatus of claim 7, wherein the sub-field includes, prior to the write period, a set-up period in which a pulse is applied to the pair of electrodes to equalize wall charges in the plurality of discharge cells.

30. The plasma display apparatus of claim 8, wherein the sub-field includes, prior to the write period, a set-up period in which a pulse is applied to the pair of electrodes to equalize wall charges in the plurality of discharge cells.

31. The plasma display apparatus of claim 7, wherein the sub-field includes, prior to the write period, a set-up period in which a pulse is applied to the pair of electrodes to equalize wall charges in the plurality of discharge cells.

32. The plasma display apparatus of claim 10, wherein the sub-field includes, prior to the write period, a set-up period in which a pulse is applied to the pair of electrodes to equalize wall charges in the plurality of discharge cells.

33. The plasma display apparatus of claim 11, wherein the sub-field includes, prior to the write period, a set-up period in which a pulse is applied to the pair of electrodes to equalize wall charges in the plurality of discharge cells.

34. The plasma display apparatus of claim 2, wherein one field has only one set-up period in which a pulse is applied to the pair of electrodes to initialize the plurality of discharge cells.

35. The plasma display apparatus of claim 3, wherein one field has only one set-up period in which a pulse is applied to the pair of electrodes to initialize the plurality of discharge cells.

36. The plasma display apparatus of claim 1, wherein one field has only one set-up period in which a pulse is applied to the pair of electrodes to initialize the plurality of discharge cells.

37. The plasma display apparatus of claim 4, wherein one field has only one set-up period in which a pulse is applied to the pair of electrodes to initialize the plurality of discharge cells.

38. The plasma display apparatus of claim 5, wherein one field has only one set-up period in which a pulse is applied to the pair of electrodes to initialize the plurality of discharge cells.

39. The plasma display apparatus of claim 6, wherein one field has only one set-up period in which a pulse is applied to the pair of electrodes to initialize the plurality of discharge cells.

40. The plasma display apparatus of claim 7, wherein one field has only one set-up period in which a pulse is applied to the pair of electrodes to initialize the plurality of discharge cells.

41. The plasma display apparatus of claim 8, wherein one field has only one set-up period in which a pulse is applied to the pair of electrodes to initialize the plurality of discharge cells.

42. The plasma display apparatus of claim 7, wherein one field has only one set-up period in which a pulse is applied to the pair of electrodes to initialize the plurality of discharge cells.

43. The plasma display apparatus of claim 9, wherein one field has only one set-up period in which a pulse is applied to the pair of electrodes to initialize the plurality of discharge cells.

44. The plasma display apparatus of claim 10, wherein one field has only one set-up period in which a pulse is applied to the pair of electrodes to initialize the plurality of discharge cells.

45. The plasma display apparatus of claim 11, wherein one field has only one set-up period in which a pulse is applied to the pair of electrodes to initialize the plurality of discharge cells.

46. The plasma display apparatus of claim 12, wherein one field has only one set-up period in which a pulse is applied to the pair of electrodes to initialize the plurality of discharge cells.

47. A method for driving a plasma display panel in which a plurality of discharge cells are formed between a pair of substrates, said method comprising:

applying a set-up pulse to the plurality of discharge cells for initializing the plurality of discharge cells, said set-up pulse including a portion having a waveform that falls from positive to negative on a trailing edge is applied;

applying a writing pulse to the plurality of discharge cells for performing writing; and applying a plurality of discharge pulses to the plurality of discharge cells for sustaining discharge, wherein an initial pulse in the plurality of discharge pulses has a larger pulse width than other pulses in the plurality of discharge pulses.

48. A method for driving a plasma display panel in which a plurality of discharge cells are formed between a pair of substrates, said method comprising:

applying a set-up pulse to the plurality of discharge cells for initializing the plurality of discharge cells, said set-up pulse including a portion having a waveform that falls from positive to negative on a trailing edge is applied;

applying a writing pulse to the plurality of discharge cells for performing writing; and applying a plurality of discharge pulses to the plurality of discharge cells for sustaining discharge, wherein said plurality of discharge pulses include a first pulse, a second pulse and a third pulse in this order, a pulse-width of said second pulse is smaller than a pulse-width of the first pulse, and the pulse-width of said second pulse is smaller than a pulse-width of the third pulse.

49. A plasma display apparatus comprising:

a plasma display panel in which a first substrate and a second substrate are disposed with a gap there between, a plurality of pairs of first and second electrodes being disposed on the first substrate, a plurality of third electrodes being disposed on the second substrate, a plurality of discharge cells being formed between the first substrate and the second substrate, and the first, the second and the third electrodes being included in the discharge cells; and a driving circuit that drives the plasma display panel in such a manner that one field includes an set-up period, a write period and a discharge sustain period, wherein in the discharge sustain period, the driving circuit applies pulses such that an initial pulse has a larger pulse width than other pulses applied in the discharge sustain period, and in the set-up period, a pulse including a portion having a waveform that falls from positive to negative on a trailing edge is applied.

50. A plasma display apparatus comprising:

a plasma display panel in which a first substrate and a second substrate are disposed with a gap there between, a plurality of pairs of first and second electrodes being disposed on the first substrate, a plurality of third electrodes being disposed on the second substrate, a plurality of discharge cells being formed between the first substrate and the second substrate, and the first, the second and the third electrodes being included in the discharge cells; and a driving circuit that drives the plasma display panel in such a manner that one field includes an set-up period, a write period and a discharge sustain period, wherein in the discharge sustain period, the driving circuit applies pulses such that at least one of a plurality of pulses applied in a later part of the discharge sustain period has a pulse width smaller than an initial pulse applied in the discharge sustain period and larger than pulses applied in an earlier part of the discharge sustain period except for the initial pulse, and in the set-up period, the driving circuit applies a pulse including a portion having a waveform that falls from positive to negative on a trailing edge.

* * * * *